US006197465B1

(12) United States Patent
Matsuzaki et al.

(10) Patent No.: US 6,197,465 B1
(45) Date of Patent: Mar. 6, 2001

(54) CARRIER FOR ELECTROPHOTOGRAPHY AND DEVELOPER FOR ELECTROPHOTOGRAPHY USING THE CARRIER

(75) Inventors: Shigeo Matsuzaki; Takashi Arakane; Kazuo Murakata, all of Sodegaura; Susumu Kikuchi, Tokyo; Hisashi Mukataka; Yuji Kamiyama, both of Watarai-gun, all of (JP)

(73) Assignees: Idemitsu Kosan Co., Ltd., Tokyo; Kyocera Corporation, Kyoto, both of (JP)

( * ) Notice: Subject to any disclaimer, the term of this patent is extended or adjusted under 35 U.S.C. 154(b) by 0 days.

(21) Appl. No.: 09/426,647

(22) Filed: Oct. 25, 1999

Related U.S. Application Data

(63) Continuation-in-part of application No. 09/147,033, filed as application No. PCT/JP97/04563 on Dec. 11, 1997, now abandoned.

(30) Foreign Application Priority Data

Dec. 11, 1996 (JP) ..... 8-330757
Oct. 30, 1998 (JP) ..... 10-325992

(51) Int. Cl.[7] ..... G03G 9/107
(52) U.S. Cl. ..... 430/106.6; 430/108; 430/137
(58) Field of Search ..... 430/106.6, 108, 430/137

(56) References Cited

U.S. PATENT DOCUMENTS

| | | | |
|---|---|---|---|
| 5,079,124 | 1/1992 | Kawata et al. | 430/108 |
| 5,085,963 | 2/1992 | Suzuki et al. | 430/106.6 |
| 5,093,201 | 3/1992 | Ohtani et al. | 428/407 |
| 5,166,027 | 11/1992 | Machida et al. | 430/106.6 |
| 5,252,398 | 10/1993 | Ohtani et al. | 428/403 |
| 5,272,037 | 12/1993 | Ohtani et al. | 430/108 |
| 5,641,601 | 6/1997 | Mitani et al. | 430/106.6 |
| 5,652,060 | 7/1997 | Uchida et al. | 428/404 |
| 5,919,593 | 7/1999 | Karima et al. | 430/108 |
| 5,968,699 | 10/1999 | Matsuzaki et al. | 430/106.6 |

FOREIGN PATENT DOCUMENTS 10-171168 6/1998 (JP) .

*Primary Examiner*—John Goodrow
(74) *Attorney, Agent, or Firm*—Oblon, Spivak, McClelland, Maier & Neustadt, P.C.

(57) ABSTRACT

A carrier for electrophotography includes a carrier core material provided with magnetism and a coating layer which coats the surface of the carrier core material and includes a high molecular weight polyethylene resin having a weight average molecular weight of 50,000 or more. An outermost layer containing a magnetic powder having a three-dimensional form of a convex polyhedron is formed on the outermost surface of the coating layer.

11 Claims, 10 Drawing Sheets

CARRIER FOR ELECTROPHOTOGRAPHY AND DEVELOPER FOR ELECTROPHOTOGRAPHY USING THE CARRIER

This application is a Continuation-in-part (CIP) of application Ser. No. 09/147,033 filed on Sep. 15, 1998, now abandoned which was filed as an International Application PCT/JP97/04563 on Dec. 11, 1997.

TECHNICAL FIELD

The present invention relates to a carrier for electrophotography and a developer for electrophotography using the carrier. More particularly it relates to a carrier for electrophotography used in development of an electrostatic latent image in image formation using electrophotography, and to a developer using the carrier.

BACKGROUND OF THE INVENTION

As an electrostatic latent image development for electrophotography, one-component magnetic jumping development, one-component non-magnetic contacting development, and two-component development, in which development is performed by frictionally electrifying a toner, transporting a developer, and contacting with an electrostatic latent image, by mixing an insulating non-magnetic toner and magnetic carrier particles, are known so far.

Particularly attention has been paid gain to application of the two-component development to the color printer as a promising method in near future.

A particulate carrier, which is used in such two-component development, is usually produced by coating a magnetic carrier core material with an appropriate material in order to prevent filming a toner onto the surface of the carrier, to form a carrier-uniform surface, to elongate the lifetime of a developer, to prevent damage of a sensitizer by a carrier, to control charge quantity, or for other purposes.

Conventional resin-coated carriers are not, however, satisfactory in durability because the coat is easily exfoliated by an impact such as stirring applied when used or for other reasons.

To solve this problem, the inventors developed and proposed a method to form a polyolefin-based resin coat by directly carrying out polymerization of an olefin-based monomer on carrier-core-material particles of materials such as ferrite, as described, for example, in Japanese Patent Laid-open Pub. No. Hei. 2-187771. The polyolefin-based resin-coated carrier obtained according to this method, 1) has the strong adhesion strength between the core material and the coat, 2) does not give any deterioration in the quality of image, 3) is excellent in durability, and 4) is excellent in spent stability, even if copying is repeated continuously for a long time, because the coat is directly formed on the carrier core material particles.

On the other hand, however, this polyolefin-based resin-coated carrier did not have adequate durability, not only because control of charge polarity and adjustment of charge quantity can not be freely conducted, but also because of the problem that the external additives are spent by attachment of external additives of a toner or for other reasons.

In addition, the carrier did not have enough properties which allow fine adjustment of resistance and adjustment of image density.

As methods to solve the above-mentioned problems, a method to improve charge quantity by containing nigrosin in a carrier-coated resin is disclosed in Japanese Patent Laid-open Pub. No. Sho. 53-100242, a method to improve fluidity by adding a fluidity-improving agent is disclosed in Japanese Patent Laid-open Pub. No. Sho. 61-9661, and a method, to prevent making the charging property uniform and being spent by adding one selected from a group consisting of electroconductive fine particles, inorganic filler particles, and a charge-controlling agent, is disclosed in Japanese Patent Laid-open Pub. No. Hei. 2-210365.

These methods, however, could not satisfy both 1) freely controlling charge polarity, adjusting charge quantity, and adjusting resistance, with taking advantage of an excellent property that the above-mentioned polyolefin-based resin-coated carrier has, and 2) preventing external additives of a toner from being spent.

While, the carriers produced by coating magnetic particles with a resin are disclosed in U.S. Pat. Nos. 5,079,124, 5,085,963 and 5,652,060. All of these carriers, however, use globular magnetic particles as the carrier core material provided with magnetism which is used in the present invention. These carriers not only nonuse convex polyhedron magnetic particles but also are provided with no outermost layer containing convex polyhedron magnetic particles. The object of the present invention in which the convex polyhedron magnetic particles are added to the outermost layer to secure easy control of charge quantity is unattainable by the technologies disclosed in these patent publications.

In U.S. Pat. No. 5,641,601, a toner provided with convex polyhedron magnetic particles stuck to the surface thereof is disclosed. However, this toner is not used for a carrier. Also, even if this toner is combined with the invention disclosed in U.S. Pat. No. 5,079,124, the structure of the invention cannot be attained. Hence, the object of the present invention to secure easy control of charge quantity is unattainable by the technologies disclosed in U.S. Pat. No. 5,641,601.

The present invention aims to solve the above-mentioned problems, i.e. the purpose of the present invention is to provide a carrier for electrophotography and a developer using the carrier, which allows adjusting the charge quantity and static resistance freely, with taking advantage of an excellent property that a carrier having a polyolefin-based resin coat has, obtaining an image stable in light and shade, and effectively preventing external additives from being spent by attachment of external additives of a toner.

DISCLOSURE OF THE INVENTION

The above object can be attained by the provision of a carrier for electrophotography according to the present invention comprising a carrier core material provided with magnetism and a coating layer (a covering layer) which coats the surface of the carrier core material and comprises a high molecular weight polyethylene resin having a weight average molecular weight of 50,000 or more, wherein an outermost layer containing a magnetic powder having a three-dimensional form of a convex polyhedron is formed on the outermost surface (outer surface) of the coating layer.

In the structure of the carrier for electrophotography according to the present invention, preferably the magnetic powder having a three-dimensional form of a convex polyhedron is embedded in the coating layer and the surface polyethylene coating layer is formed so as to coat the magnetic powder.

According to another aspect of the present invention, there is provided a process for producing a carrier for electrophotography comprising a carrier core material provided with magnetism and a coating layer which coats the surface of the carrier core material and comprises a high molecular weight polyethylene resin having a weight average molecular weight of 50,000 or more, the process comprising forming the coating layer by a direct polymerization method and thereafter embedding a magnetic powder, having a three-dimensional form of a convex polyhedron, in the coating layer by a mechanical impact to form an outermost layer.

In the process for producing the carrier for electrophotography according to the present invention, preferably the magnetic powder having a three-dimensional form of a convex polyhedron is embedded in the coating layer at a temperature ranging between 50 and 120° C. by a mechanical impact to form an outermost layer and the surface polyethylene coating layer is formed so as to coat the magnetic powder.

According to a further aspect of the present invention, there is provided a developer for electrophotography comprising the above carrier for electrophotography and a toner, wherein the mixing ratio of the carrier for electrophotography is in a range from 2 to 40% by weight to the total amount of the carrier and the toner.

BEST MODE FOR CARRYING OUT THE INVENTION

Figure 1:
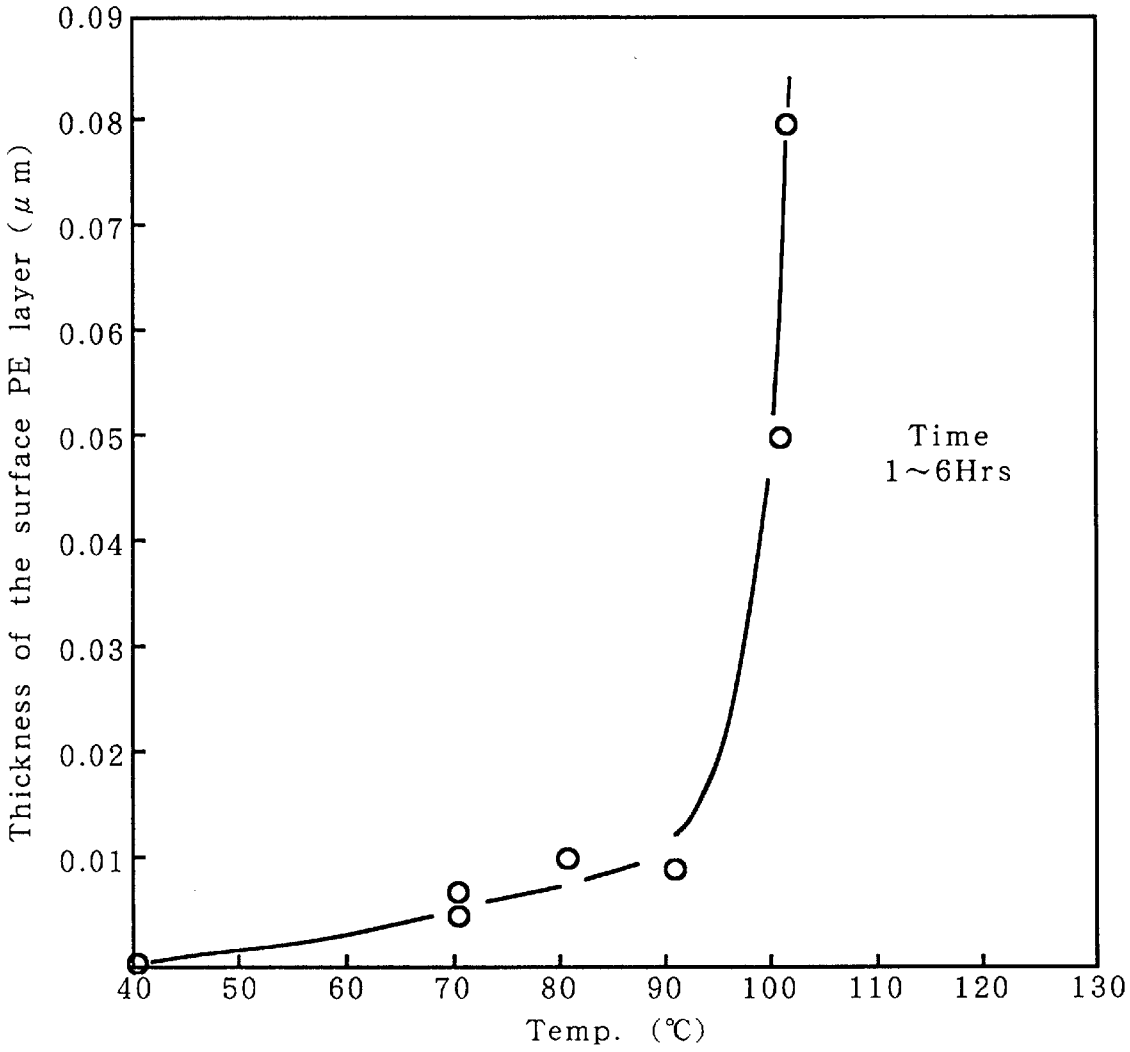
FIG. 1 is a view showing the relation between treating temperature and the thickness of a surface polyethylene layer.

The embodiments of a carrier for electrophotography and a developer for electrophotography using the carrier according to the present invention will be explained concretely below.

I. Carrier for electrophotography

The carrier for electrophotography according to the present invention has a carrier core material and a coating layer (a covering layer) consisting of a high-molecular-weight polyethylene resin coating the surface of the carrier core material, wherein said coating layer consisting of a high-molecular-weight polyethylene resin contains a layer containing magnetic powder that is a convex polyhedron that is encompassed by both or either at least six flat and curved planes in the three-dimensional geometry at least as its outermost layer, or a layer containing the above magnetic powder and silica, or a layer containing the above magnetic powder, silica and a fine particle resin.

Each component will be explained concretely below.

1. Carrier core material (1) Material

There is no particular limitation to the core material of carrier according to the present invention. Well known materials for the two component-system carrier for electrophotography can be used, such as 1) ferrite, magnetite, or the like; metals such as iron, nickel, and cobalt, 2) an alloy or a mixture of these metals with a metal such as copper, zinc, antimony, aluminum, lead, tin, bismuth, beryllium, manganese, magnesium, selenium, tungsten, zirconium, and vanadium, 3) a mixture of the above-mentioned ferrite or the like with a metal oxide such as iron oxide, titanium oxide, and magnesium, a nitride such as chromium nitride and vanadium nitride; a carbide such as silicon carbide and tungsten carbide, and 4) ferromagnetic ferrite, and 5) a mixture of these.

(2) Geometry and particle size

There is no particular limitation to the geometry of the carrier core material. Both or either spherical and irregular forms are acceptable. Although there is no particular limitation to an average particle size, the average particle size of 20–100 $\mu$m is preferable. If the average particle size is smaller than 20 $\mu$m, attachment (scattering) of the carrier to the electrostatic latent image carrier (a sensitizer in general) may occur. If the average particle size is larger than 100 $\mu$m, troubles such as carrier streaks may occur and cause deterioration of the quality of image.

(3) Ratio of formulation

The weight ratio of the carrier core material per the overall carrier is set to 90 wt. % or higher, preferably to 95 wt. % or higher. The ratio of formulation indirectly specify the thickness of the resin-coated layer of the carrier. If the weight ratio is lower than 90 wt. %, there may be the case that the coating layer becomes too thick, and the durability and the stability of charge which are required for a developer might not be satisfied because of exfoliation of the coating layer, increase in the charge quantity, and other reasons, even if the carrier is practically applied to a developer. Also it may cause troubles such as low reproducibility in fine lines and decrease in image density with respect to the quality of image. Although there is no particular limitation to the upper limit, such a ratio may be enough that the coated resin layer can completely coat the surface of the carrier core material. This value depends on the physical properties of the carrier core material and the method for coating.

(4) Electroconductive layer

An electroconductive layer can be formed on the carrier core material particles prior to coating with a high-molecular-weight polyethylene resin if necessary.

As the electroconductive layer formed on the carrier core material particles, for example, one, in which electroconductive fine particles are dispersed in an appropriate binding resin, is favorable. The formation of such an electroconductive layer is effective in enhancing a developing property and obtaining clear images having high image density and clear contrast. The reason for this is considered that the existence of the electroconductive layer lowers electroresistance of the carrier to a suitable level to balance leak and accumulation of electric charge.

As the electroconductive fine particle added to the electroconductive layer, the followings can be used: carbon black such as carbon black and acetylene black, carbide such as SiC, magnetic powder such as magnetite, $SnO_2$, and titanium black. As the binding resin of the electroconductive layer, the followings can be used: various thermoplastic resins and thermosetting resins such as polystyrene-based resins, poly(metha)acrylic acid-based resins, polyolefin-based resins, polyamide-based resins, polycarbonate-based resins, polyether-based resins, polysulfonic acid-based resins, polyester-based resins, epoxy-based resins, polybutyral-based resins, urea-based resins, urethane/urea-based resins, silicone-based resins, and Teflon(trademark)-based resins, and a mixture, a copolymer, a block polymer, a graft polymer, and a polymer blend of these resins.

The electroconductive layer can be formed by coating a liquid in which the above-mentioned electroconductive fine particles are dispersed in the above-mentioned appropriate binding resin onto the surface of the carrier core material particles by a method such as the spray coating method and the dipping method. In addition, it can also be formed by melting/blending/crushing the core material particles, electroconductive fine particles, and a binding resin. In addition, it can also be formed by polymerizing a polymerizable monomer on the surface of the core material particle in the presence of the electroconductive fine particles. Although there is no particular limitation to factors such as the size and the amount of addition of the above-mentioned electroconductive fine particles as long as the properties such as electroresistance of the carrier according to the present invention are satisfied, an average particle size of the electroconductive fine particle should be one that allows homogeneous dispersion in the above-mentioned resin solution: concretely 0.01–2 $\mu$m, preferably 0.01–1 $\mu$m. Although the amount of the electroconductive fine particles to add also depends on the kind and other factors and it is not possible to specify it, a weight ratio of 0.1–60 wt. % per the binding resin of the electroconductive layer, preferably 0.1–40 wt. % would be acceptable. Although such a trouble occurs that the reproducibility decreases when fine lines are copied repeatedly using a carrier like this when the packing ratio of the carrier is as small as ca. 90 wt. % and the thickness of the coating layer is relatively thick, this kind of trouble can be dissolved by adding the above-mentioned electroconductive fine particles.

The carrier core material particles on which a functional layer such as an electroconductive layer was formed will also be designated hereafter simply as "carrier core material particles" as long as misunderstanding can be avoided.

2. Coating layer consisting of a high-molecular-weight polyethylene resin (1) Molecular weight of a resin High-molecular-weight polyethylene resins, which are usually designated as "polyethylene", having a number-average molecular weight of 10,000 or higher or a weight-average molecular weight of 50,000 or higher are preferably used in the present invention. The followings waxes having a number-average molecular weight lower than 10,000 are generally excluded from the high-molecular-weight polyethylene resins for the present invention: polyethylene wax (Mitsui High Wax, manufactured by Mitsui Petrochemical Industries, Ltd.), Dialene 30 (manufactured by Mitsubishi Gas Chemical Co., Ltd.), Nisseki Lexpole (manufactured by Nippon Oil Co., Ltd.), San Wax (manufactured by Sanyo Chemical Co., Ltd.), Polyrez (neutral wax, manufactured by Polymer Co., Ltd.), Neowax (manufactured by Yasuhara Chemical Co., Ltd.), AC Polyethylene (manufactured by Allied Chemical Inc.), Eporene (manufactured by Eastman Kodak Co.), Hoechst Wax (manufactured by Hoechst Co., Ltd.), A-Wax (manufactured by BASF Co., Ltd.), Polywax (manufactured by Petrolite Co., Ltd.), Escomer (manufactured by Exxon Chemical Co., Ltd.), or the like. The polyethylene wax may be coated by the conventional dipping method and the spray method by dissolving in hot toluene or the like. However, since the mechanical strength of the polyethylene wax is weak, it is exfoliated by the shear in a developing machine after a long-term use or for other reasons.

It is also acceptable to add at least one kind of functional particles such as the above-mentioned electroconductive fine particles and particles having an ability to control the electric charge, which will be described later, into the coating layer consisting of the above-mentioned high-molecular-weight polyethylene resin.

(2) Method for forming coating layer

There is no particular limitation to form a coating layer used in the present invention. Although well known methods such as the dipping method, the fluidized bed method, the dry-type method, and the spray dry method can be applied, the following polymerization method is preferred to coat the polyethylene-based resin because the resin-coating strength is strong and the coat is not be exfoliated easily.

a. Polymerization method

"The polymerization method" is a method to produce a polyethylene resin-coated carrier by treating the surface of the carrier core material with an ethylene-polymerizing catalyst and directly polymerizing ethylene (forming polyethylene) on the surface, as described, for example, in Japanese Patent Laid-open Pub. No. Sho. 60-106808 and Japanese Patent Laid-open Pub. No. Hei. 2-187770. The polyethylene resin-coated layer can be formed by suspending a product that is obtained in advance by contacting a highly active catalytic component that contains both or either titanium and zirconium, and is soluble in a hydrocarbon solvent, such as hexane and heptane, with the carrier core material, and an organoaluminum compound in the above-mentioned hydrocarbon solvent, supplying an ethylene monomer, and polymerizing it on the surface of the carrier core material. In addition, in case fine particles or electroconductive fine particles having the above-mentioned an electric charge-conferring function are added, they can be added while the above-mentioned high-molecular-weight polyethylene resin-coated layer is formed.

As this production forms a polyethylene-coated layer directly on the surface of the carrier core material, a coat excellent in strength and durability is obtained.

If functional fine particles such as electroconductive fine particles and fine particles having an ability to control electric charge are dispersed/coexisted in the polymerization system in this way, while a high-molecular-weight polyethylene resin coat is growing/being formed by polymerization, the functional fine particles are incorporated into this coat, and a high-molecular-weight polyethylene resin coat containing the functional particles is formed.

b. Amount of coating

A high-molecular-weight polyethylene resin coat is formed with a weight ratio of [carrier core material]/[high-molecular-weight polyethylene resin coat] being preferably in a range of 99.5/0.5–90/10, more preferably in a range of 99/1–95/5.

c. Addition and supporting of functional fine particles

The quality of the carrier can be improved, as described above, by adding/carrying at least one kind of functional particles, such as electroconductive fine particles and particles having an ability to control electric charge, in the high-molecular-weight polyethylene resin coat.

As electroconductive fine particles which are added/carried in high-molecular-weight polyethylene resin coat, can be used all well-known ones, for example, carbide such as carbon black and SiC, electroconductive magnetic powder such as magnetite, $SnO_2$, titanium black. A preferable average particle size of the electroconductive fine particles is 0.01–5.0 μm.

(3) Outermost layer

The coating layer has a layer containing magnetic powder that is a convex polyhedron that is encompassed by at least six flat and/or curved planes in the three-dimensional geometry at least as its outermost layer, or a layer containing said magnetic powder and silica and/or fine particle resin. It is noted that the layer containing said magnetic powder and silica and/or fine particle resin is called as its outermost layer in the case that the later-described surface polyethylene is formed on the outermost layer.

a. Magnetic powder

Magnetite, ferrite, iron powder, or the like can be used as a material for the magnetic powder used in the present invention.

The three-dimensional geometry of the magnetic powder is a convex polyhedron that is encompassed by both or either at least six flat and curved planes. Although "polyhedron" usually means a steric body that is encompassed only with flat planes, "polyhedron" in the present invention is referred to as a solid body that is encompassed with both or either flat and curved planes. The existence of angles and vertices formed by flat and curved planes like this is important.

If the carrier is a polyhedron like this, as the electroconduction changes from the surface-electroconduction mechanism to the point-electroconduction mechanism in a convex part of a polyhedron, the efficiency in electroconduction is improved. For the polyhedron, both a single kind and a combination of a plurality of kinds are acceptable.

The average particle diameter (size) is preferably 0.1–1 μm, more preferably 0.2–0.7 μm. If the diameter is smaller than 0.1 μm, the effect as a spacer might be lost. If the diameter is larger than 1 μm, there may be the case where the addition to its outermost layer becomes impossible.

The resistance is preferably 1E+7($1\times10^7$)–1E+10($1\times10^{10}$) Ω.cm, more preferably 1E+7($1\times10^7$)–1E+9($1\times10^9$) Ω.cm. If the resistance is smaller than 1E+7 Ω.cm, a charge property might be prevented. If the resistance is larger than 1E+10 Ω.cm, adjustment of the resistance might become impossible, and the function as a magnetic powder might not be performed.

They are commercially available, for example, from Mitsui Metal Co. as Magnetite MG-1306 (octahedron, the average particle diameter 0.2 μm) and Magnetite MG-3900 (polyhedron, the average particle diameter 0.2 μm).

b. Silica

Silica, whose surface was hydrophobically treated and positively or negatively charged, can be used in the present invention.

The particle size is preferably equal to or smaller than 40 nm in primary size, more preferably 10–30 nm. If the size is larger than 40 nm, gaps between silica particles may become large and ruggedness is generated on the surface of the carrier.

As positively charged silica, for example, RA200HS (manufactured by Nippon Aerosol Co., Ltd.), 2015EP, and 2050EP (both Wacker Chemicals Co., Ltd.) are commercially available. As negatively charged silica, for example, R812, RY200 (both manufactured by Nippon Aerosol Co., Ltd.), 2000, and 2000/4 (both Wacker Chemicals Co., LTD) are commercially available.

It is preferable to add negatively charged silica to a positively charged toner, and to add positively charged silica to a negatively charged toner.

c. Fine particle resin

The following negatively charged resins (A) and positively charged resins (B) can be used as the fine particle resin according to the present invention.

A. Negatively charged resins

Fluorine-based resin (such as a fluorovinylidene resin, a tetrafluoroethylene resin, a trifluorochloroethylene resin, and a tetrafluoroethylene/hexafluoroethylene copolymer resin), a vinyl chloride-based resin, and celluloid.

B. Positively charged resins

An acryl resin, a polyamide-based resin (such as nylon-6, nylon-66, and nylon-11), a stylene-based resin (polystylene, ABS, AS, and AAS), a chlorovinylidene resin, a polyester-based resin (such as polyethylene terephthalate, polyethylene naphthalate, polybutylene terephthalate, polyacrylate, polyoxybenzoyl, and polycarbonate), a polyether-based resin (such as polyacetal and polyphenylene ether), and an ethylene-based resin (such as EVE, EEA, EAA, EMAA, EAAM, and EMMA).

It is preferable to add a negatively charged resin to a positively charged toner, and to add a positively charged resin to a negatively charged toner.

It is acceptable to contain both above-mentioned silica and particle resin as well as to contain one of them. In addition, one kind or a plurality of kinds of silica can be used, and one kind or a plurality of kinds of particle resin(s) can be used.

d. Coat thickness

The coat thickness of its outermost layer is preferably 0.1–6 μm. If it is thinner than 0.1 μm, coating might become incomplete. If it is thicker than 6 μm, its outermost layer might be exfoliated by a mechanical impact such as friction from the outside.

e. Formation and fixing method of outermost layer

Formation and fixing method of outermost layer used in the present invention can be performed, depending on particle size and geometry of the magnetic powder to use and physical properties, such as particle size, solubility to organic solvents, melting point, and hardness, of silica and/or a resin, by selecting a method from the following two methods or by combining them.

(i) Fixing by mechanical impact

A Henshel mixer or the like, such as a 20C/I-type Henshel mixer manufactured by Mitsui Miike Chemical Machine Co. , Ltd. is preferably used to perform formation and fixing by a mechanical impact.

Here, although there is the case where the degree of the mechanical impact is altered corresponding to the amount of the coating (the amount of polyethylene) in the carrier core material, the amount of the magnetic powder or the amount of silica particles and microparticle resin used in combination with the magnetic powder, it is generally desirable that one throughput be designed to be in a range between 3 and 20 kg and the number of revolutions be designed to be in a range between 200 and 3000 rpm.

The treating temperature when the mechanical impact is applied is in a range between preferably 50 and 120° C., more preferably 60 and 110° C. and most preferably 70 and 100° C. This is because when treating temperature is less than 50° C., embedment of the magnetic powder in the coating layer tends to be difficult and there is the case where a surface polyethylene coating layer with appropriate thickness is not formed. Hence there is the case where the charging characteristics are greatly changed in a high temperature and high humidity condition.

On the contrary, when the temperature exceeds 120° C., there is the case where the carriers are deposited among themselves to produce excess carriers and to make the thickness of the surface polyethylene coating layer too large, resulting in a large change in the charging characteristics in a low temperature and low humidity condition.

The above point will be explained in more detail with reference to FIGS. 1 and 2. FIG. 1 is a view showing the relation between treating temperature and the thickness of a surface polyethylene layer and FIG. 2 is a view showing the relation between the thickness of a surface polyethylene layer and a variation in charge quantity.

FIG. 1 is made based on the data obtained in Examples 6 to 12, wherein the abscissa indicates treating temperature (° C.) and the ordinate indicates the thickness ($\mu$m) of a surface polyethylene coating layer. As is understood from FIG. 1, the treating temperature closely relates to the thickness of the surface polyethylene coating layer. There is a tendency that the thickness of the formed surface polyethylene coating layer increases with an increase in treating temperature. There is also observed a tendency that the thickness of the surface polyethylene coating layer becomes remarkably thick at a temperature around 100 (° C.) or more.

Figure 2:
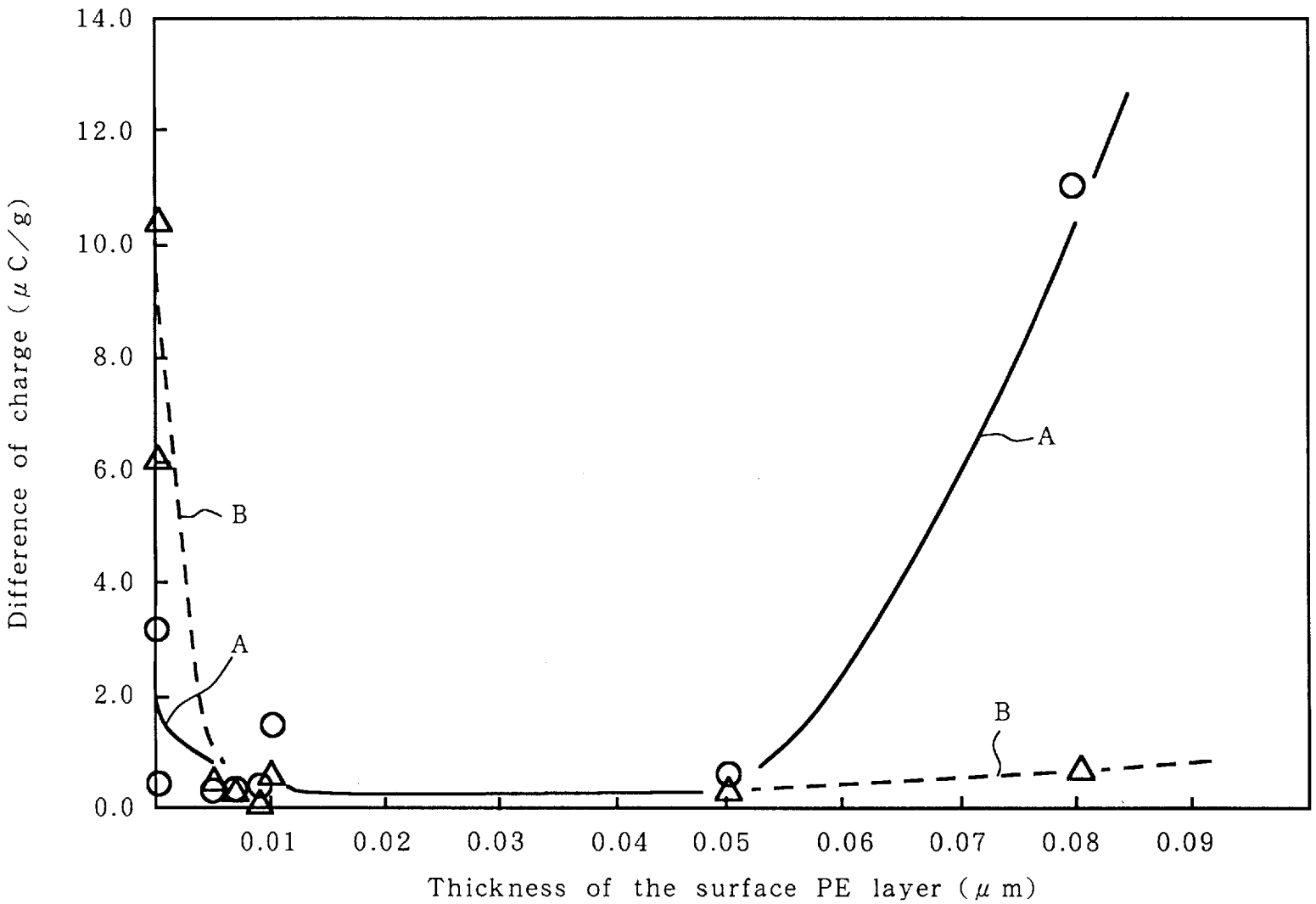
FIG. 2 is a view showing the relation between the thickness of a surface polyethylene layer and a variation in charge quantity.
Figure 3:
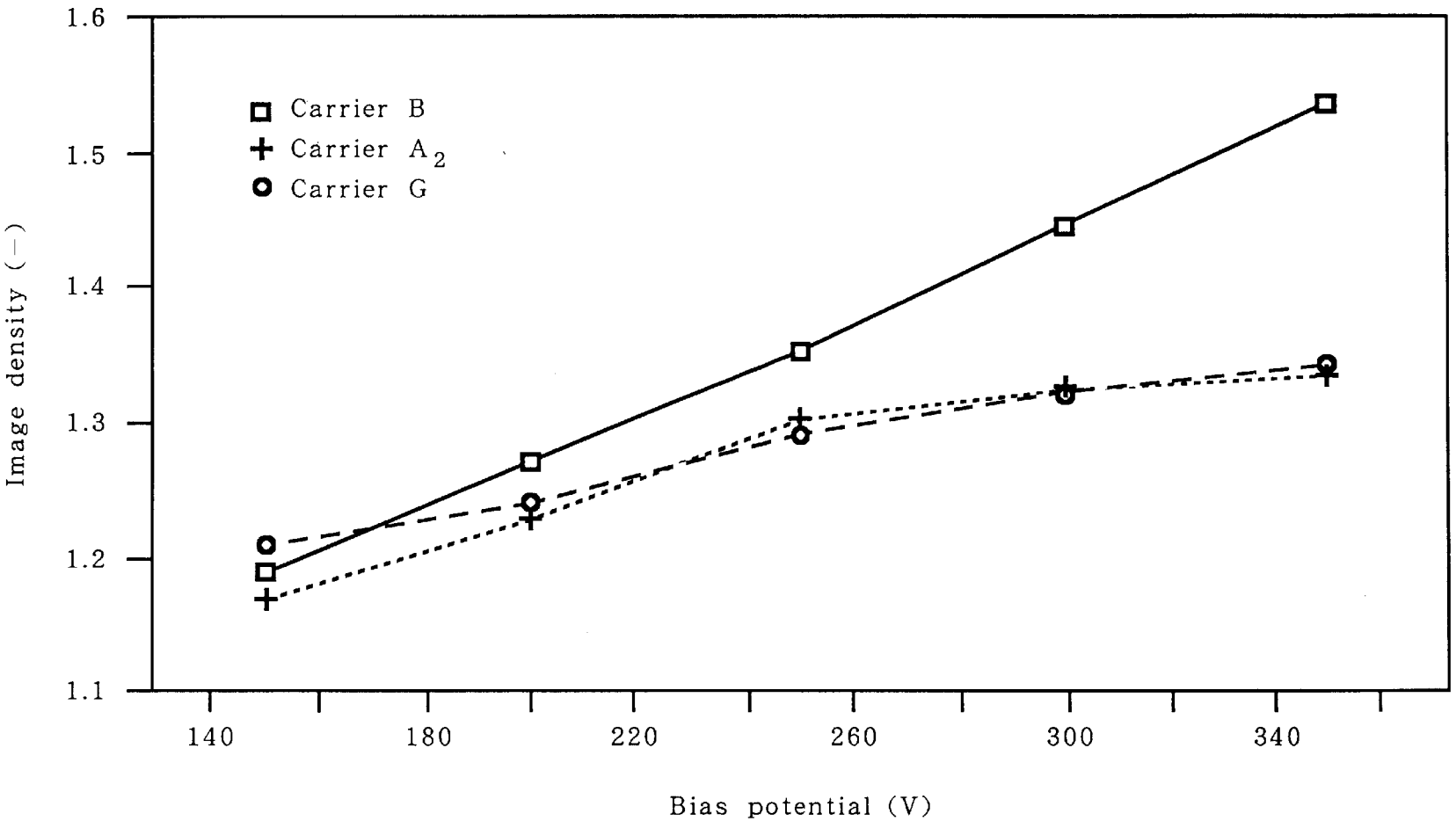
FIG. 3 is a view for explaining the magnet roller bias potential dependency of an image density in Applied Example 1 of the present invention.

FIG. 2 is made based on the data obtained in Examples 6 to 12 and in Comparative Example 1, wherein the abscissa indicates the thickness ($\mu$m) of surface polyethylene coating layer and the ordinate indicates a difference in charge quantity ($\mu$C/g). Incidentally, the solid line A shows a difference in charge quantity (hereinafter noted as a difference LL–NN in charge quantity) calculated by subtracting the value of charge quantity (NN charge quantity) measured under a normal temperature and normal humidity circumstance from the value of charge quantity (LL charge quantity) measured under a low temperature and low humidity circumstance. The dot line B, in turn, shows a difference in charge quantity (hereinafter noted as a difference NN–HH in charge quantity) calculated by subtracting the value of charge quantity (HH charge quantity) measured under a high temperature and high humidity circumstance from the value of charge quantity (NN charge quantity) measured under a normal temperature and normal humidity circumstance.

As is understood from FIG. 2, a difference in charge quantity tends to increase when the thickness of the surface polyethylene coating layer is too large or too small. When the thickness of the surface polyethylene coating layer is too large, the value of the difference LL–NN in charge quantity tends to increase as shown by the solid line A. When the thickness of the surface polyethylene coating layer is too small, the value of the difference NN–HH in charge quantity tends to increase as shown by the dot line B.

Hence, the thickness of the surface polyethylene coating layer to be formed can be limited to the value falling within a prescribed range, for example, 0.005 to 0.08 $\mu$m by applying a mechanical impact at appropriate treating temperatures. This makes it possible to reduce a change in the charging characteristics of the carrier with a change in ambient conditions, specifically to reduce it to 2 $\mu$C/g or less, preferably 1 $\mu$C/g or less and more preferably 0.5 $\mu$C/g or less.

It is desirable that the treating time in the application of a mechanical impact should be generally 0.5 to 6 hours though there is the case where it is altered corresponding to the amount of the coating (the amount of polyethylene) in the carrier core material, the amount of the magnetic powder or the amount of silica particles and microparticle resin used in combination with the magnetic powder.

When a mechanical impact is applied using a Henshel mixer, there is the case where a magnetic powder and the like remain unburied and it is hence preferable to carry out sufficient screening and classification after mechanical impact treatment.

(ii) Thermal fixation by heating

Its outermost layer is formed by mixing the high-molecular-weight polyethylene resin-coated carrier and an appropriate amount of magnetic powder or a mixture prepared by mixing the magnetic powder and both or either silica and fine particle resin using a machine, which can heat, such as the Thermal Spheronizing Machine (Hosokawa Micron Co., Ltd.). The amount of magnetic powder and the amount of silica and/or fine particle resin to add then are determined by absolute value of charge quantity to change and stability of real printing image density.

Although, concretely, it is usual to add at a weight ratio of 0.1–50 phr (external additives per coating resin) per 100 phr of the coating polyethylene of a high-molecular-weight polyethylene-coated carrier, an appropriate ratio is 20–30 phr, considering durability and change in resistance accompanying the formation of its outermost layer, production stability.

In the thermal spheronization treatment, it is necessary to uniformly attach magnetic powder and both or either silica and a fine particle resin to the surface of the high-molecular-weight polyethylene resin-coated carrier before the treatment. For this purpose, a mixing treatment such as the ball-mill treatment, the V-blender treatment, and the Henshel-mixer treatment (for ca. 1 min) is carried out to electrostatically or mechanically attach the particles of magnetic powder and both or either silica and fine particle resin onto the surface of the high-molecular-weight polyethylene resin-coated carrier. Fixing was performed and an outermost layer is formed by heating for a very short time with uniformly attaching onto the surface of the high-molecular-weight polyethylene resin-coated carrier.

f. Surface polyethylene coating layer

Figure 10:
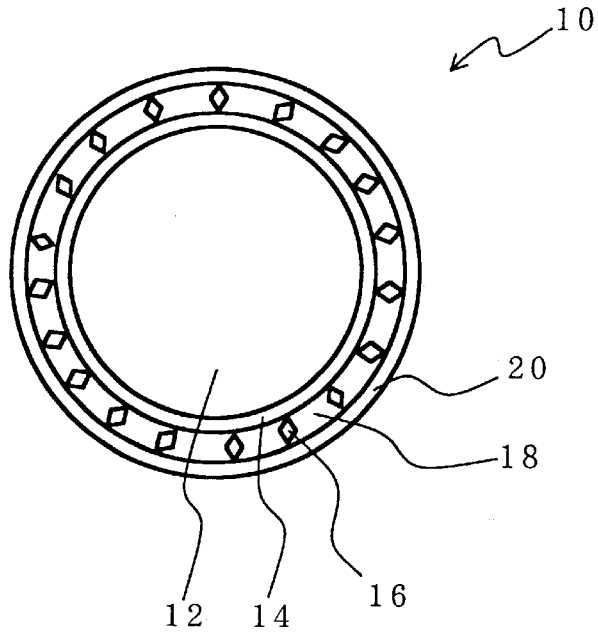
FIG. 10 is a sectional view of a carrier of the present invention which is provided with a surface polyethylene coating layer.

In the structure of the carrier for electrophotography as shown in FIG. 10, preferably a coating layer 14 which coats a carrier core material 12 having magnetism and an outermost layer 18 in which a magnetic powder 16 having a convex polyhedron is embedded are formed on the surface of the carrier core material 12 and a surface polyethylene coating layer (a surface polyethylene covering layer) 20 is further formed on the surface of the outermost layer 18 so as to cover the magnetic powder 16.

Figure 11:
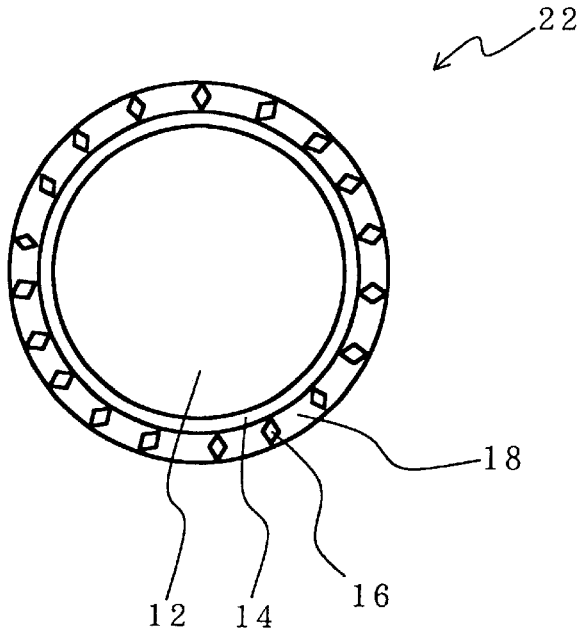
FIG. 11 is a sectional view of a carrier of the present invention which is not provided with a surface polyethylene coating layer.

The section of a carrier 22 provided with no surface polyethylene coating layer is also shown in FIG. 11 for the sake of understanding of the surface polyethylene coating layer 20.

When the carrier is structured such that the magnetic powder is not exposed as shown in FIG. 10, absorption of water in air can be efficiently prevented because the magnetic powder having a convex polyhedron form is not in direct contact with air. Therefore, the influence of water in air, namely, the effect of moisture is overcome to attain better control of charging characteristics by the carrier.

The thickness of the surface polyethylene coating layer is preferably in a range from 0.005 to 0.08 $\mu$m. This is because when the thickness of the surface polyethylene coating layer is less than 0.005 $\mu$m, there is the case where the magnetic powder having a convex polyhedron form easily absorbs water in air whereas when the thickness exceeds 0.08 μm, there is the case where the charging characteristics is controlled with difficulty on the contrary.

Hence, the thickness of the surface polyethylene coating layer is in a range from more preferably 0.008 to 0.05 μm and most preferably 0.01 to 0.04 μm.

It is noted that the aforementioned surface polyethylene coating layer may be formed at the same time when the outermost layer in which the magnetic powder having a convex polyhedron form is embedded is formed. Alternatively, the surface polyethylene coating layer may be formed on the surface of the outermost layer after the outermost layer has been formed.

For instance, in the case of forming the surface polyethylene coating layer and the outermost layer simultaneously, the both layers can be formed with accuracy by designing the treating time in the Henshel mixer to be 2 hours or more, or the treating temperature to fall in a range between 50 and 120° C. Specifically, the magnetic powder is embedded in the polyethylene resin, applied to the carrier core material, to a relatively great depth to separate a polyethylene resin layer as the outermost layer including the magnetic powder from a polyethylene resin layer as the surface polyethylene coating layer excluding the magnetic powder, thereby forming the both layers simultaneously.

3. Electroconductive property of carrier

Although the optimal electroconductivity of a carrier depends on the system of the developer in which the carrier is used, a carrier showing a value of $1\times10^{2}$–$1\times10^{14}$ Ω.cm is preferred in general.

If the value is lower than $1\times10^{2}$ Ω.cm, carrier development and overlapping may occur. If the value is higher than $1\times10^{14}$ Ω.cm, deterioration in the quality of image such as lowering of the image density may occur.

Resistance values were determined by placing a carrier layer having an electrode area of 5 $cm^2$, a load of 1 kg, and a thickness of 0.5 cm, applying a voltage of 1–500 V to both upper and lower electrodes, measuring current values flowing in the bottom, and converting the values.

4. Average particle size of carrier

Although the optimal average particle size of a carrier depends on the system of the developer in which the carrier is used, for example, the average particle size is preferably in a range from 20 to 120 μm, more preferably in a range from 20 to 100 μm and the most preferably in a range from 20 to 80 μm.

If the average particle size is lower than 20 μm, carrier development may occur and the conveying ability of the carrier may be difficult. If the average particle size is higher than 120 μm, overlapping may occur.

II. Developer for electrophotography

The developer for electrophotography according to the present invention can be obtained by mixing various toners with the above-mentioned carrier.

1. Toner

As a toner used in the present invention, the toner, which was produced according to a well-known method such as the suspension polymerization method, the crushing method, the microcapsule method, the spray dry method, and the mechanochemical method, can be used, and at least binder resins, coloring agents, and other additives such as electric charge-controlling agents, lubricants, off-set-preventing agents, and fixation-enhancing agents can be formulated, if necessary, to effectively improve a developing property and prevent scattering of a toner in the machine. In addition, fluidizing agents can also be added to improve its fluidizability. Binder resins which can be used are polystylene-based resins such as polystylene, stylene/butadiene copolymer, and stylene/acryl copolymer; ethylene-based copolymers such as polyethylene, ethylene/vinyl acetate copolymer, and ethylene/vinyl alcohol copolymer; epoxy-based resins; phenol-based resins; acryl phthalate resin; polyamide resin; polyester-based resins; and maleic acid resin. Coloring agents which can be used are well known dyes/pigments such as carbon black, Copper Phthalocyanine Blue, Indus MeliaBlue, Peacock Blue, Permanent Red, Red Oxide, Alizarin Rake, Chrome Green, Malachite Green Rake, Methyl Violet Rake, Hansa Yellow, Permanent Yellow, and titanium oxide. Electric charge-controlling agents which can be used are positive electric charge-controlling agents such as nigrosin, nigrosin base, triphenylmethane-based compounds, polyvinylpyridine, and quaternary ammonium salt; and negative electric charge-controlling agents such as metal-complexes of alkyl-substituted salicylic acid (e.g. a chromium complex or a zinc complex of di-tert-butylsalicylic acid). Lubricants which can be used are Teflon (trademark, tetrafuluoroethylene), zinc stearate, and polyfluorovinylidene. Off-set-preventing/fixation-enhancing agents which can be used are a polyolefin wax or the like such as low-molecular-weight polypropylene and its modification. Magnetic materials which can be used are magnetite, ferrite, iron, and nickel. Fluidizing agents which can be used are silica, titanium oxide, aluminum oxide, or the like.

The average size of the toner is preferably equal to or lower than 20 μm, more preferably 5–15 μm.

2. Mixing ratio

The weight ratio of toner/carrier according to the present invention is 2–40 wt. %, preferably 3–30 wt. %, more preferably 4–25 wt. %. If the ratio is lower than 2 wt. %, the toner charge quantity may become high, and there may be the case where enough image density is not obtained. If the ratio is higher than 40 wt. %, there may be the case where enough charge quantity is not obtained, and the toner scatters from the developing machine and pollutes inside the copying machine, or causes toner-overlapping.

3. Usage

The developer according to the present invention is used in the 2- and 1.5-component-type electrophotography system such as the copying machine (analogue, digital, monochrome, and color type), the printer (monochrome and color type), and the facsimile, especially most suitably in the high-speed/ultra-high-speed copying machine and printer or the like in which the stress applied to the developer is high in the developing machine. There is no particular limitation to the type of image-formation, the type of exposure, the type (apparatus) of development, and various types of control (e.g. the type of controlling the density of a toner in a developing machine). One can adjust it to an optimal resistance, an average particle diameter(size)/particle diameter(size) distribution, a magnetic power, and an charge quantity of the carrier and the toner, depending on the system.

EXAMPLES

The examples of the present invention will be described more concretely below.

Production of Carrier (1) Preparation of titanium-containing catalytic component Into a 500-ml flask whose atmosphere was replaced for argon, 200 ml of dried n-heptane and 15 g (25 mmol) of magnesium stearate that had been dried at 120° C. under a reduced pressure (2 mmHg) were added at room temperature to make a slurry. After 0.44 g (2.3 mmol) of titanium tetrachloride was dropwise added with stirring, the content began to be heated, the reaction was carried out under reflux for 1 hour, and a clear viscous solution of a titanium-containing catalyst (the active catalyst) was obtained.

(2) Evaluation of activity of titanium-containing catalytic component

Into a 1-liter autoclave whose atmosphere was replaced for argon, 400 ml of dried hexane, 0.8 mmol of triethylaluminum, 0.8 mmol of diethylaluminun chloride, and 0.004 mmol (as titanium atom) of the titanium-containing catalytic component obtained in (1) were added, and the content was heated up to 90° C., wherein the inner pressure of the system was 1.5 kg/cm$^2$G. After hydrogen was supplied up to 5.5 kg/cm$^2$G, ethylene was continuously supplied maintaining the total pressure at 9.5 kg/cm$^2$G. Polymerization was carried out for 1 hour, giving 70 g of polymer. The polymerization activity was 365 kg/g.Ti/Hr, and MFR (melt flow rate at 190° C., a loading of 2.16 kg according to JIS K 7210) of the polymer obtained was 40 g/min.

(3) Production of polyethylene-coated carrier

Into a 2-liter autoclave whose atmosphere was replaced for argon, 960 g of sintered ferrite powder F-300 (Powder Tech Corp., average particle size 50 $\mu$m) was added, the content was heated up to 80° C., and drying was carried out under a reduced pressure (10 mmHg) for 1 hour. After the content was cooled down to 40° C., 800 ml of dried hexane was added, and mixing was started. After 5.0 mmol of diethylaluminum chloride and the titanium-containing catalytic component described in (1) (0.05 mmol as titanium atom) were added, reaction was carried out for 30 min. Then, the content was heated up to 90° C., 4 g of ethylene was introduced, with the inner pressure being 3.0 kg/cm$^2$G. After hydrogen was supplied up to 3.2 kg/cm$^2$G, 5.0 mmol of triethylaluminum was added to start polymerization. The inner pressure of the system went down to and was stabilized at 2.3 kg/cm$^2$G in ca. 5 min. Then, a slurry containing 5.5 g of carbon black (Mitsubishi Chem. Co., MA-100) in 100 ml of dried hexane was added, polymerization was carried out continuously supplying ethylene, with keeping the inner pressure at 4.3 kg/cm$^2$G for 45 min (the supply was stopped when 40 g of ethylene was introduced into the system), and 1005.5 g of carbon black-containing polyethylene resin-coated ferrite was obtained. Died powder of it was uniformly black. Electron-microscopic observation revealed that the surface of the ferrite was coated with a thin polyethylene layer and the carbon black is uniformly dispersed in the polyethylene layer. Thermal gravimetric analysis (TGA) of the composite revealed that the weight ratio of ferrite/carbon black/polyethylene was 95.5/0.5/4.0.

The intermediate-step carrier obtained through this step was designated as "the carrier $A_1$". The weight-average molecular weight of the coating polyethylene was 206,000.

Then carrier $A_1$ was classified using a sieve of 125 $\mu$m to remove particles which are equal to or larger than 125 $\mu$m in diameter. The carrier after the classification was added into a fluidized-bed type gas-flow classifier having a height of 14 cm, and heated air (115° C.) was blown in to give at a linear velocity of 20 cm to fluidize the carrier for 10 hours. Thus carrier $A_2$ was obtained.

Example 1

Into a 10-liter Henshel mixer (Mitsui Miike Co., FM10L), 1000 g of the carrier $A_2$ was added and mixed for 1 hr to give mechanical impact and to smoothen the surface of carrier $A_2$. Then 8 g of magnetic powder (Mitsui Metal Co., Magnetite MG1306, octahedron, the average particle diameter of 0.2 $\mu$m) was added and mixed for another 1 hr to give mechanical impact to form outermost layer containing magnetic powder. To remove magnetic powder existing unfixed freely, the large particle size carrier and the aggregated magnetic powder were removed using a sieve. In addition, to remove particles such as the unfixed magnetic powder, treatment was carried out using a fluidized-bed type gas-flow classifier at a linear velocity of 20 cm for 2 hours. Thus carrier B was obtained.

Example 2

Carrier C was obtained according to the same method as Example 1 except that 20 g of magnetic powder was used instead of 8 g.

Example 3

Into a 10-liter Henshel mixer (Mitsui Miike Chemical Eng. Machine Co., Ltd. FM10L), 1000 g of the carrier $A_2$ and mixed for 1 hr to give mechanical impact and to smoothen the surface of carrier $A_2$. Then 8 g of magnetic powder (manufactured by Mitsui Metal Co., LTD., Magnetite MG1306, octahedron) was added and mixed for another 1 hr to give mechanical impact, and 12 g of silica (manufactured by Nippon Aerosil Co., LTD., R812) was added and mixed for another 1 hr to give mechanical impact, forming magnetic powder-silica-containing outermost layer. To remove magnetic powder existing unfixed freely, the large particle size carrier and the aggregated magnetic powder were removed using a sieve. In addition, to remove particles such as the unfixed magnetic powder, treatment was carried out using a fluidized-bed type gas-flow classifier at a linear velocity of 20 cm for 2 hours. Thus carrier D was obtained.

Example 4

1000 g of the carrier $A_2$ was placed into a 10-liter Henshel mixer (Mitsui Miike Chemical Machine Co., Ltd. FM10L). Then 8 g of the magnetic powder (manufactured by Mitsui Mining & Smeling Co., LTD., Magnetite MG1306, octahedron) and 8 g of a micropowdered resin (manufactured by Soken Kagaku Co., LTD., MP2701) were added and mixed for 1 minute, whereby these were caused to adhere to the surface of the carrier $A_2$ electrically and mechanically. Then, the mixture was heat-treated with heating air at 200° C. by using a thermal sphere forming machine (manufactured by Hosokawa Micron Co., Ltd., Thermal Sphere Forming Machine) to fix the magnetic powder and the micropowdered resin into the melted coating polyethylene resin layer, whereby the outermost layer mixed with the magnetic powder and the micropowdered resin was formed. The carrier with a large diameter, coagulated magnetic powder and coagulated micropowdered resin were removed by using sieve classification for the purpose of eliminating excesses of the magnetic powder and micropowdered resins existing free without being fixed. Also, the resultant product was processed using a fluidized-bed type air flow classification at an air flow linear velocity of 20 cm for two hours for the purpose of eliminating excesses of the magnetic powder and micropowdered resins without being fixed. Thus carrier E was obtained.

Example 5

Carrier F was obtained according to the same method as Example 1 except that Magnetite MG9300 (manufactured by Mitsui Metal Co., Ltd., the average particle diameter (size) of 0.2 μm) was used instead of Magnetite MG1306 (manufactured by Mitsui Mining & Smeling Co., Ltd.).

Comparative Example 1

Carrier $A_2$ obtained in the carrier production example was not further treated and evaluated in the same way of Example 1.

Comparative Example 2

Carrier G was obtained according to the same method as Example 1 except that Magnetite MG8200 (manufactured by Mitsui Metal Co., sphere, the average particle diameter (size) of 0.2 μm) was used instead of Magnetite MG1306 (manufactured by Mitsui Metal Co.).

Toner B was obtained by adequately mixing the above materials using a ball mill, blending using three rolls heated at 140° C., cooling the mixture by standing, and roughly crushing using a feather mill, and further finely crushing using a jet mill.

Evaluation of real printing was carried out by evaluating density of the printed part by using the Macbeth densitometer after printing at various bias potentials. Also static resistance and charge quantity were simultaneously measured. Measurement of charge quantity was carried out using a charge quantity-measuring device (Toshiba Chemical Co., Ltd. TB-200). The measurement was carried out by mixing 0.5 g of a toner and 9.5 g of a carrier, putting the mixture into a 500-ml plastic bottle, tumbling in a ball mill for 1 hr, at a blow pressure of 0.8 kg/cm$^2$, for a blowing time of 50 sec, using a 500-mesh stainless steel sieve.

TABLE 1

| Kind of | Charge quantity (μC/g) | | Static Resistance | Image density (Measured at each bias potential) | | | | |
|---|---|---|---|---|---|---|---|---|
| carrier | Toner A | Toner B | (Ω cm) | 150 V | 200 V | 250 V | 300 V | 250 V |
| Carrier $A_2$ | +11.2 | −13.5 | 3.1E + 11 | 1.17 | 1.23 | 1.30 | 1.32 | 1.33 |
| Carrier B | +10.9 | −13.1 | 1.1E + 10 | 1.19 | 1.27 | 1.35 | 1.44 | 1.53 |
| Carrier C | +11.0 | −12.9 | 8.9E + 08 | | | | | |
| Carrier D | +18.2 | −7.2 | 7.8E + 12 | | | | | |
| Carrier E | +7.5 | −19.3 | 6.3E + 13 | | | | | |
| Carrier F | +11.2 | −13.3 | 2.7E + 11 | | | | | |
| Carrier G | +10.8 | −13.4 | 2.5E + 10 | 1.21 | 1.24 | 1.29 | 1.32 | 1.34 |

Applied Example 1

Evaluation of real printing was carried out, using the toners A and B with respect to each of the carriers $A_2$–G obtained in Examples 1–5 and Comparative Examples 1 and 3, using a machine that was modified from Ecosys 5 3550 (Kyocera Co.) in such a way that amorphous silicon was used as a photoreceptor when a positively charged toner was evaluated, that an organic electrophotography photoreceptor was used when a negatively charged toner was evaluated, and that the surface potential of the photoreceptor and the magnet roller bias potential could be adjusted. Results of evaluation of real printing, charge quantity, and static resistance are summarized in Table 1.

The followings were used as Toner A and Toner B:

Toner A:

Stylene/n-butylmethacrylate copolymer resin
100 wt. parts

Carbon black (Mitsubishi Chem. Co., MA#8)
5 wt. parts

Dye (Orient Chem. Ind. Co., N07)
5 wt. parts

Toner A was obtained by adequately mixing the above materials using a ball mill, blending using three rolls heated at 140° C., cooling the mixture by standing, and roughly crushing using a feather mill, and further finely crushing using a jet mill.

Toner B:

Bisphenol A-based polyester resin
100 wt. parts

Carbon black (Cabot Corp., BPL)
8 wt. parts

Dye (Orient Chem. Ind. Co., E-84)
5 wt. parts

Dependence of image density on magnet roller bias potential in Applied Example 1 is illustrated in FIG. 1.

As it is clear from the description above, by making the geometry of magnetic powder to add to an outermost layer of the carrier for electrophotography, which is used as a developer for electrophotography, octahedron or the like, the proportional relation between bias potential and image density is obtained, the increasing rate of image density is still high even at a high bias potential, and obtaining clear light and shade in printing and stable image becomes possible.

Applied Example 2

Figure 4:
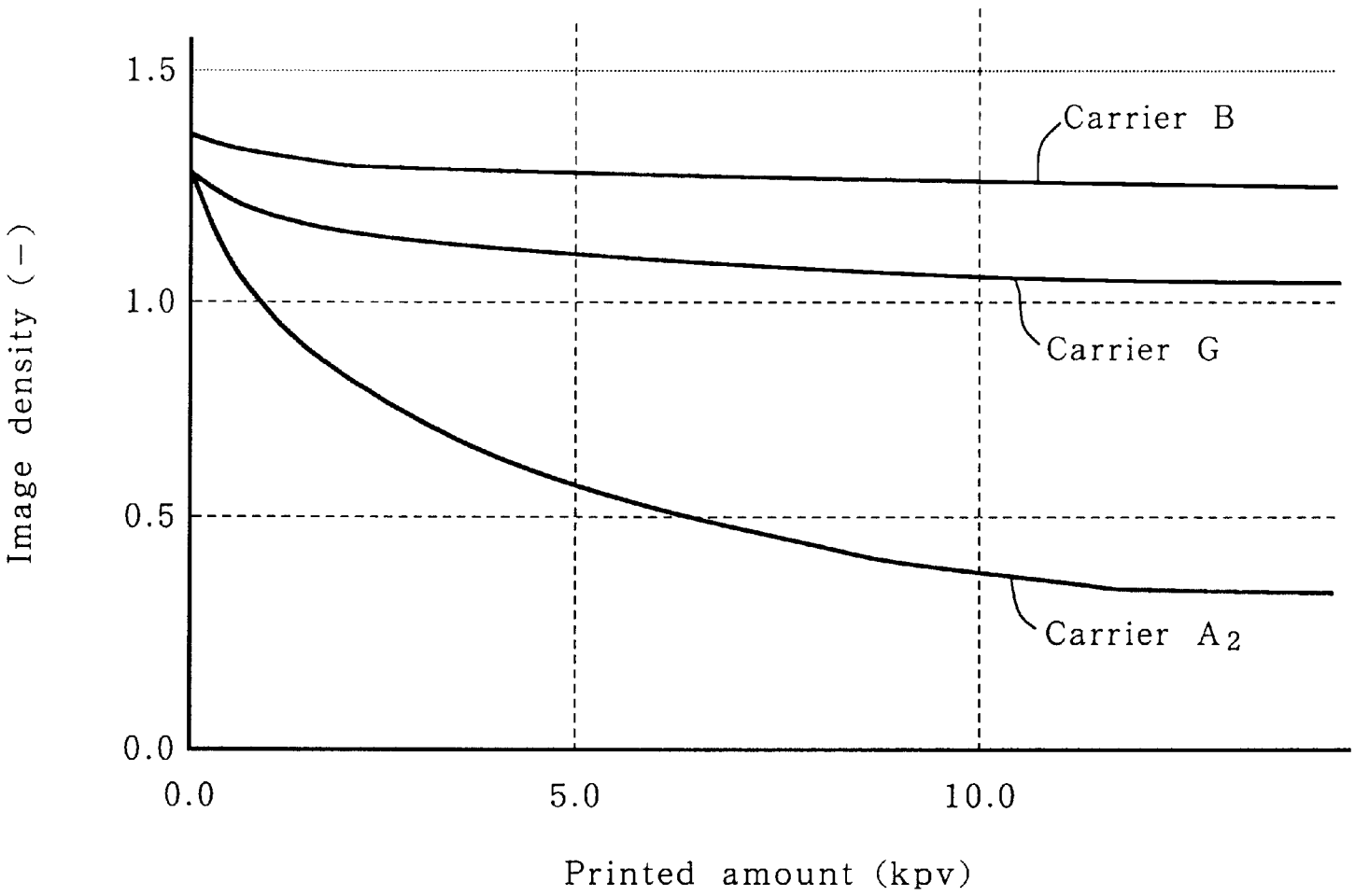
FIG. 4 is a view showing the results of evaluation of continuous printing in Applied Example 2 of the present invention.

Carriers B, $A_2$, or G obtained in Example 1, Comparative Example 1, or Comparative Example 3, respectively, was mixed with a toner (Kyocera Corporation, Ecotone (trademarak)) at a toner concentration of 5 wt. % (T/C), loaded into a Printer FS3550 (Kyocera Corporation, Ecosys (trademarak)), and evaluation of continuous printing was carried out. The result is summarized in FIG. 4.

Example 6

10 kg of the carrier $A_2$ was placed in a Henshel mixer (FM2OC/I-model, manufactured by Mitsui Miike Chemical machine Co., Ltd.) with a capacity of 20 l. Hot water was flowed through a jacket formed around the Henshel mixer to raise the temperature (treating temperature) in the Henshel mixer to 70° C. The Henshel mixer was allowed to work to agitate the carrier for 0.5 hours while the temperature was kept at 70° C., thereby applying a mechanical impact to the carrier to smooth the surface of the carrier $A_2$.

Then, 200 g of Magnetite MG1306 was mixed as the magnetic powder and thereafter the Henshel mixer was operated for 3 hours to apply a mechanical impact, thereby forming a magnetic powder-containing polyethylene resin layer (outermost layer) and a surface polyethylene coating layer simultaneously on the carrier $A_2$. In addition, for the purpose of removing magnetic powder which was not fixed and remained in a free condition, though its amount was small, the resulting product was treated in a screening process (#125 mesh) and a classifying process (using a fluidized-bed air classifier, linear velocity: 20 cm, 2 hours) to obtain a carrier H.

a. Observation by scanning electron microscope (SEM).

Figure 7:
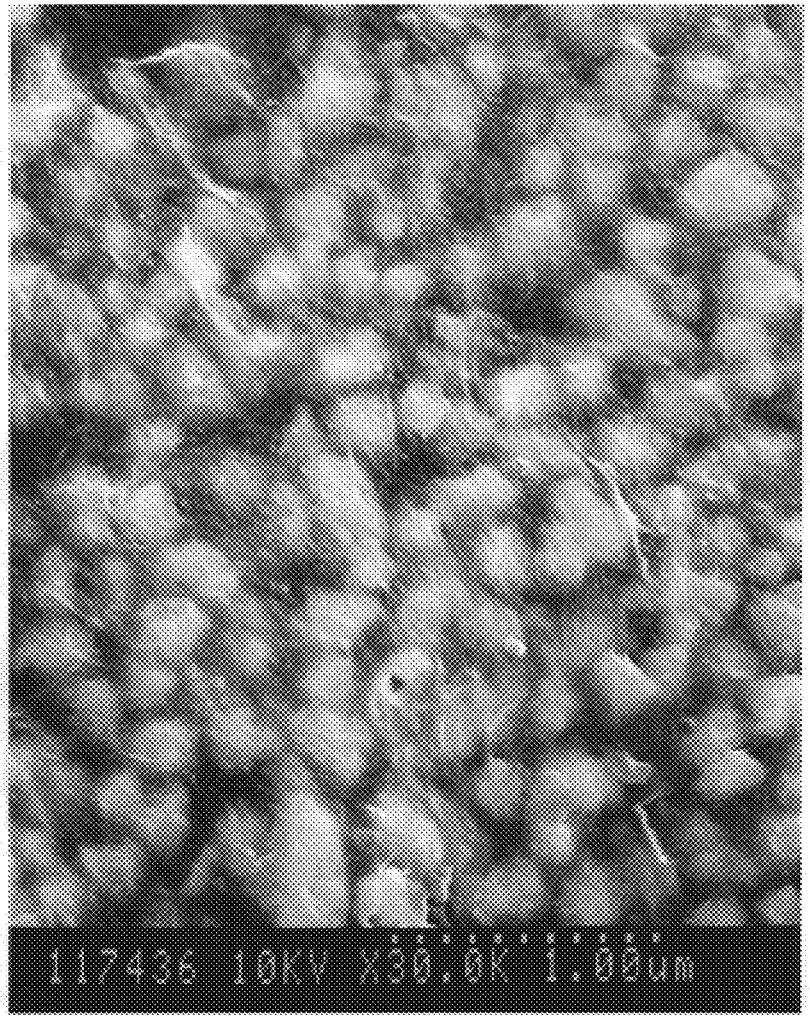
FIG. 7 is a photograph taken by a scan-type electron microscope showing the surface of a carrier obtained in Example 6.
Figure 8:
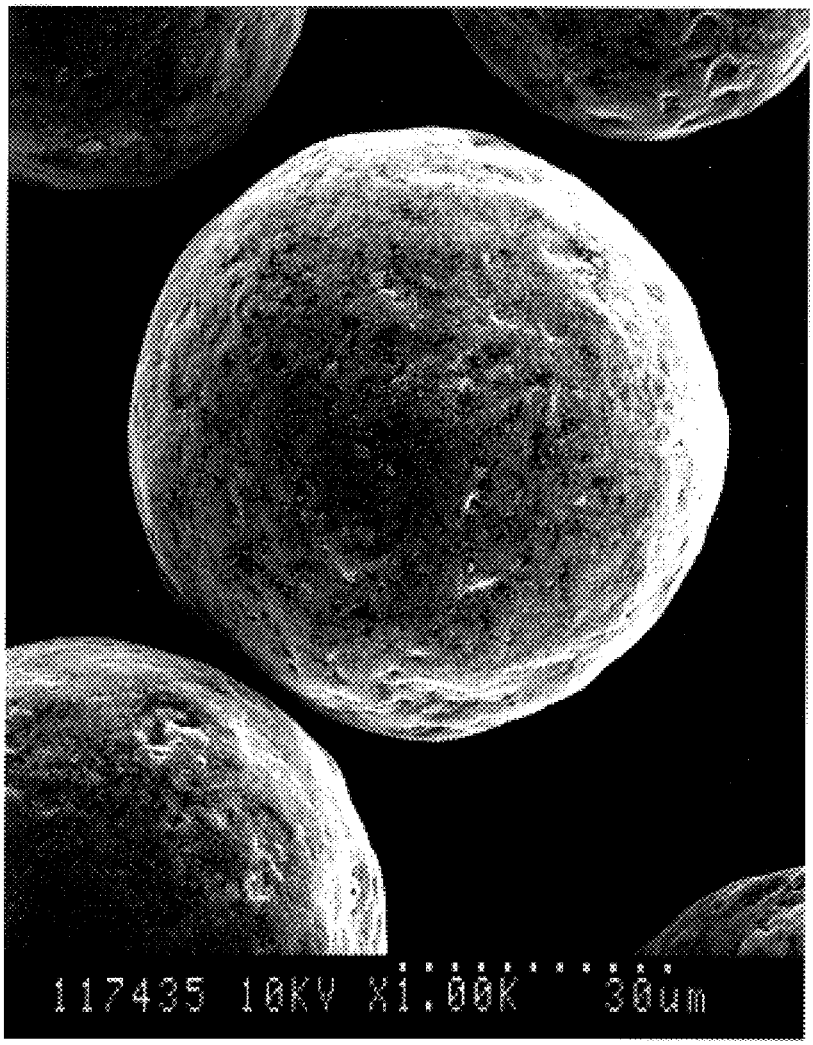
FIG. 8 is a photograph taken by a scan-type electron microscope showing the entire of the carrier obtained in Example 6.

The surface of the resulting carrier was observed using an SEM. As a result, it was confirmed that, as shown in FIG. 7, a magnetic powder having a octahedron form was embedded in a polyethylene resin, which is a coating layer, in the condition that a surface polyethylene coating layer is formed. Therefore, it was confirmed that the surface polyethylene coating layer was formed on the surface of the magnetic powder and the magnetic powder having a octahedron form was not exposed from the surface. It was also confirmed that the surface of the carrier H on which the surface polyethylene coating layer was formed was extremely smooth and the carrier H was entirely close to a true sphere.

b. Auger electron spectrometry

The thickness of the surface polyethylene coating layer formed on the magnetic powder in the resulting carrier H was confirmed using an Auger electron spectrometry apparatus JAMP-7100 (manufactured by JEOL). To state in more detail, a scanning electron microscope was used to confirm the position of the magnetic powder in the plane direction in advance and argon ($Ar^+$) sputtering and Auger electron spectrometry were repeated to make a measuring chart (profile in the direction of thickness). The time until an Fe element contained in the magnetic powder was detected was calculated by converting from the ratio of the sputtering rates of a polyethylene resin and $SiO_2$ on the basis of the measuring chart to calculate the thickness of the surface polyethylene coating layer. As a consequence, it was confirmed that the thickness of the surface polyethylene coating layer was 0.005 $\mu$m.

c. Measurement of charge quantity

The resulting carriers H were measured for the charge quantity in the following three conditions: a high temperature and high humidity condition (HH condition, temperature: 33° C., relative humidity: 85%), a normal temperature and normal humidity condition (NN condition, temperature: 25° C., relative humidity: 60%) and a low temperature and low humidity condition (LL condition, temperature: 10° C., relative humidity: 20%). 9.5 g of each carrier H and 0.5 g of a toner (TK-12 model, manufactured by Kyocera Co.) was placed in a plastic bottle, allowed to stand for 48 hours in each condition and thereafter stirred for one hour in a ball mill to charge the carrier forcibly. The carrier H and the toner were taken out from the plastic bottle to measure the charge quantity of the carrier H by using a charge quantity measuring apparatus (TB-200 model, manufactured by Toshiba Chemical Co., Ltd.) in the following condition: blowing pressure: 0.8 kg/cm$^2$, blowing time: 50 seconds, using a 500 mesh stainless wire-gauge. The results are shown in Table 2.

As is understood from the results, a difference between the charge quantities in the HH condition and in the NN condition was as small as 0.3 $\mu$C/g. Similarly, a difference between the charge quantities in the LL condition and in the NN condition was also as small as 0.3 $\mu$C/g. It was thus confirmed that the carrier H was not changed in the charging characteristics despite a change in ambient conditions.

Example 7

A carrier J was obtained in the same manner as in Example 6 except that the treating time required for applying a chemical impact against the magnetic powder was altered from 3 hours to 1 hour and the treating temperature was altered from 70° C. to 100° C. The resulting carrier J was observed using an SEM and was subjected to Auger electron spectrometry and a measurement of charge quantity in the same manner as in Example 6.

As a result, it was confirmed that a magnetic powder having a octahedron form was embedded in a polyethylene resin which is a coating layer and a surface polyethylene coating layer was formed. It was also confirmed that the thickness of the surface polyethylene coating layer formed on the surface of the magnetic powder was 0.05 $\mu$m. The charging characteristics of the carrier J are shown in Table 2.

Example 8

10 kg of the carrier $A_2$ was placed in a Henshel mixer which was the same mixer that was used in Example 6. Hot water was flowed through a jacket formed around the Henshel mixer to raise the temperature (treating temperature) in the Henshel mixer to 70° C. The Henshel mixer was allowed to work to agitate the carrier for 0.5 hours while the temperature was kept at 80° C., thereby applying a mechanical impact to the carrier to smooth the surface of the carrier $A_2$.

Then, 200 g of a magnetic powder Magnetite MG1306 which was used in Example 6 and 120 g of hydrophobic silica R812 (manufactured by Nippon Aerogyl, average diameter of primary particles: 0.02 $\mu$m) were mixed and thereafter the Henshel mixer was operated for four hours to apply a mechanical impact, thereby forming a polyethylene resin layer containing a magnetic powder and hydrophobic silica and a surface polyethylene coating layer on the carrier $A_2$. In addition, for the purpose of thoroughly removing magnetic powder and hydrophobic silica which were not fixed and remained in a free condition, though the amounts of these compounds were small, the resulting product was treated in a screening process and a classifying process in the same manner as in Example 6 to obtain a carrier K.

The resulting carrier K was observed using an SEM and was subjected to Auger electron spectrometry and a measurement of charge quantity in the same manner as in Example 6.

As a result, it was confirmed that a magnetic powder having a octahedron form and the hydrophobic silica were embedded in the outermost surface of a coating layer to form an outermost layer and a surface polyethylene coating layer was formed. It was also confirmed that the thickness of the surface polyethylene coating layer was 0.01 $\mu$m. The charging characteristics measured of the carrier K are shown in Table 2.

Example 9

10 kg of the carrier $A_2$ was placed in a Henshel mixer which was the same Henshel mixer that was used in Example 6. Hot water was flowed through a jacket formed around the Henshel mixer to raise the temperature (treating temperature) in the Henshel mixer to 90° C. The Henshel mixer was allowed to work to agitate the carrier for 0.5 hours while the temperature was kept at 90° C., thereby applying a mechanical impact to the carrier to smooth the surface of the carrier $A_2$.

Then, 200 g of a magnetic powder Magnetite MG1306 which was used in Example 6 and had a octahedron form and 80 g of charging characteristic particles MP2701

(PMMA, average particle diameter: 0.4 μm, manufactured by Souken Chemical Co., Ltd.) were mixed and thereafter the Henshel mixer was operated for 3 hours to apply a mechanical impact, thereby forming a polyethylene resin layer containing the magnetic powder and the charging characteristic particles and a surface polyethylene coating layer on the carrier $A_2$. In addition, for the purpose of tho roughly removing the magnetic powder and the charging characteristic particles which were not fixed and remained in a free condition, though the amounts of these compounds were small, the resulting product was treated in a screening process and a classifying process in the same manner as in Example 6 to obtain a carrier L.

The resulting carrier L was observed using an SEM and was subjected to Auger electron spectrometry and a measurement of charge quantity in the same manner as in Example 6.

As a result, It was confirmed that a magnetic powder having a octahedron form and charging characteristic particles were embedded in the outermost surface of a coating layer to form an outermost layer and a surface polyethylene coating layer was formed. It was also confirmed that the thickness of the surface polyethylene coating layer was 0.009 μm. The charging characteristics measured of the carrier L are shown in Table 2.

Example 10

A carrier M was obtained in the same manner as in Example 7 except that the treating time required for mixing in the Henshel mixer after the magnetic powder was mixed was altered from one hour to six hours.

The resulting carrier M was observed using an SEM and was subjected to Auger electron spectrometry and a measurement of charge quantity in the same manner as in Example 6.

As a result, it was confirmed that a magnetic powder having a octahedron form and charging characteristic particles were embedded in the outermost surface of a coating layer to form an outermost layer and a surface polyethylene coating layer was formed. It was also confirmed that the thickness of the surface polyethylene coating layer was 0.08 μm. The charging characteristics measured of the carrier M are shown in Table 2.

Example 11

A carrier N was obtained in the same manner as in Example 6 except that the type of convex magnetic powder used in Example 6 was altered from the Magnetite MG1306 (octahedron, average particle diameter: 0.2 μm, manufactured by Mitsui Mining & Smeling Co., Ltd.) to a Magnetite MG9300 (polyhedron, average particle diameter: 0.2 μm, manufactured by Mitsui Mining & Smeling Co. , Ltd.).

The resulting carrier N was observed using an SEM and was subjected to Auger electron spectrometry and a measurement of charge quantity in the same manner as in Example 6.

As a result, it was confirmed that a magnetic powder having a polyhedron form was embedded in the outermost surface of a coating layer to form an outermost layer and a surface polyethylene coating layer was formed. It was also confirmed that the thickness of the surface polyethylene coating layer was 0.007 μm. The charging characteristics measured of the carrier N are shown in Table 2.

Example 12

A carrier P was obtained in the same manner as in Example 6 except that the type of convex magnetic powder was altered from the untreated Magnetite MG1306 used in Example 6 to a Magnetite MG1306 which was treated hydrophobically using a KBM703 (γ-chloropropyltrimethoxysilane, manufactured by Shin-Etsu Chemical Co., Ltd.) which was a silane coupling agent.

In the hydrophobic treatment using a silane coupling agent, firstly a solution in which the silane coupling agent was diluted and dissolved in a mixture solution of water/alcohol was prepared. Then, the solution and a magnetic powder were placed in a universal mixing stirrer and stirred at 80° C., followed by drying. The magnetic powder which was surface-treated using a dipping method in this manner was crushed using a crusher to obtain a hydrophobically treated magnetic powder having a convex form.

The resulting carrier P was observed using an SEM and was subjected to Auger electron spectrometry and a measurement of charge quantity in the same manner as in Example 6.

As a result, it was confirmed that a hydrophobically treated magnetic powder having an octahedron form and the charging characteristic particles were embedded in the outermost surface of a coating layer to form an outermost layer and a surface polyethylene coating layer was formed. It was also confirmed that the thickness of the surface polyethylene coating layer was 0.005 μm. The charging characteristics measured of the carrier P are shown in Table 2.

Example 13

A carrier Q was obtained in the same manner as in Example 6 except that the type of convex magnetic powder was altered from the untreated Magnetite MG1306 used in Example 6 to a Magnetite MG1306 which was treated hydrophobically using a SH1107 (methyl hydrogen silicon oil, manufactured by Toray-Dow Corning Co., Ltd.) which was a silicon oil. The hydrophobic treatment using silicon oil was carried out using a dipping method in the same manner as in Example 12. The resulting magnetic powder was crushed to obtain a hydrophobically treated magnetic powder.

The resulting carrier Q was observed using an SEM and was subjected to Auger electron spectrometry and a measurement of charge quantity in the same manner as in Example 6.

As a result, it was confirmed that a hydrophobically treated magnetic powder having an octahedron form and the charging characteristic particles were embedded in the outermost surface of a coating layer to form an outermost layer and a surface polyethylene coating layer was formed. It was also confirmed that the thickness of the surface polyethylene coating layer was 0.005 μm. The charging characteristics measured of the carrier Q are shown in Table 2.

Example 14

10 kg of the carrier $A_2$ was placed in a Henshel mixer which was the same mixer that was used in Example 6. Low temperature water (20–25° C.) was flowed through a jacket formed around the Henshel mixer to control the temperature (treating temperature) in the Henshel mixer at 40° C. The Henshel mixer was allowed to work to agitate the carrier for 0.5 hours while the temperature was kept at 40° C., thereby applying a mechanical impact to the carrier to smooth the surface of the carrier $A_2$.

Then, 200 g of a magnetic powder Magnetite MG1306 which was used in Example 6 was mixed and thereafter the Henshel mixer was operated for 3 hours to apply a mechanical impact, thereby forming a polyethylene resin layer containing a magnetic powder on the carrier $A_2$. In addition, for the purpose of thoroughly removing the magnetic powder which was not fixed and remained in a free condition in a relatively large amount, the resulting product was treated in a screening process and a classifying process in the same manner as in Example 6 to obtain a carrier R.

The resulting carrier R was observed using an SEM and was subjected to Auger electron spectrometry and a measurement of charge quantity in the same manner as in Example 6.

Figure 9:
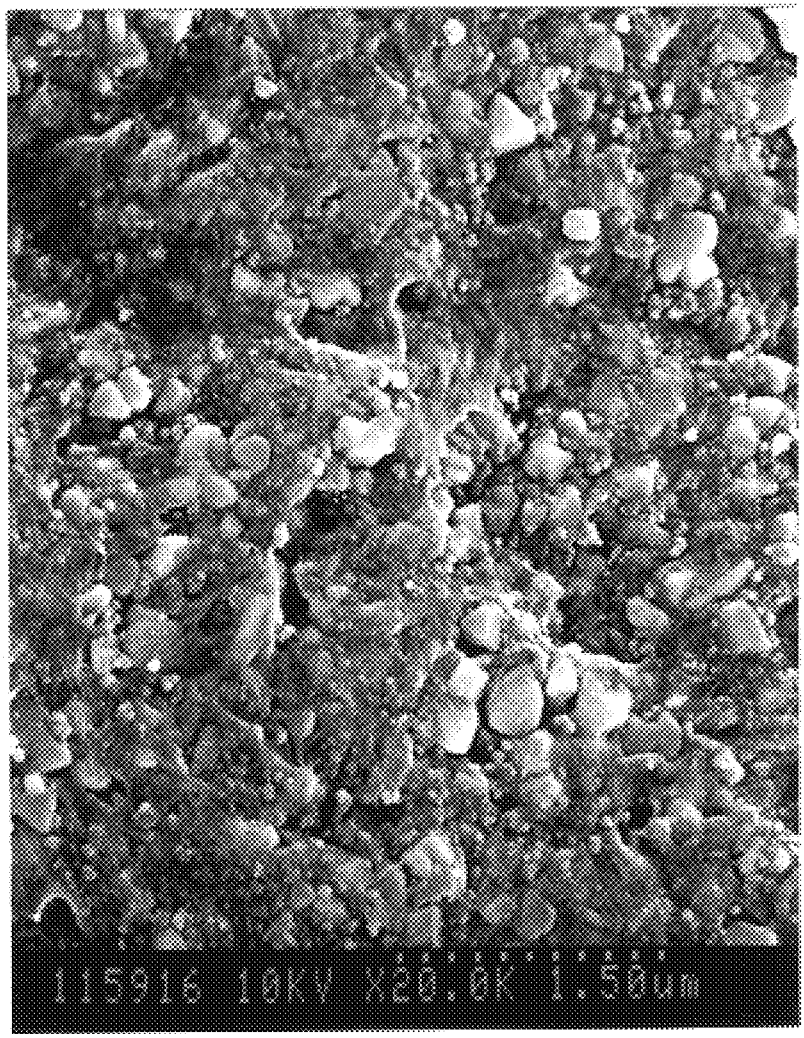
FIG. 9 is a photograph taken by a scan-type electron microscope showing the surface of a carrier obtained in Example 14.

As a result, it was confirmed that though, as shown in FIG. 9, a magnetic powder having a octahedron form was embedded in the outermost surface of a coating layer to form an outermost layer, it was exposed from the coating layer and melt-fixed and no surface polyethylene coating layer was formed. Moreover, the charging characteristics of the carrier R were measured in the same manner as in Example 6. The results are shown in Table 2.

Comparative Example 3

The charging characteristics of the carrier $A_2$ were measured in the same manner as in Example 6. The results are shown in Table 2.

Example 17 and Comparative Example 5

To each of the carriers H and $A_2$ obtained in Example 6 and Comparative Example 1 respectively was added a toner (TK-12 model, manufactured by Kyocera Co.) in a manner that the amount of the toner to be added was 5% by weight based on the total amount to form a developer for electrophotography.

Next, the resulting developers for electrophotography were respectively placed in the aforementioned printer to make an actual printing of 50,000 copies while the bias potential (voltage) was varied between 150 and 350 V and the image density of a solid portion was measured using a Macbeth densitometer. The results are shown in FIG. 6.

Figure 6:
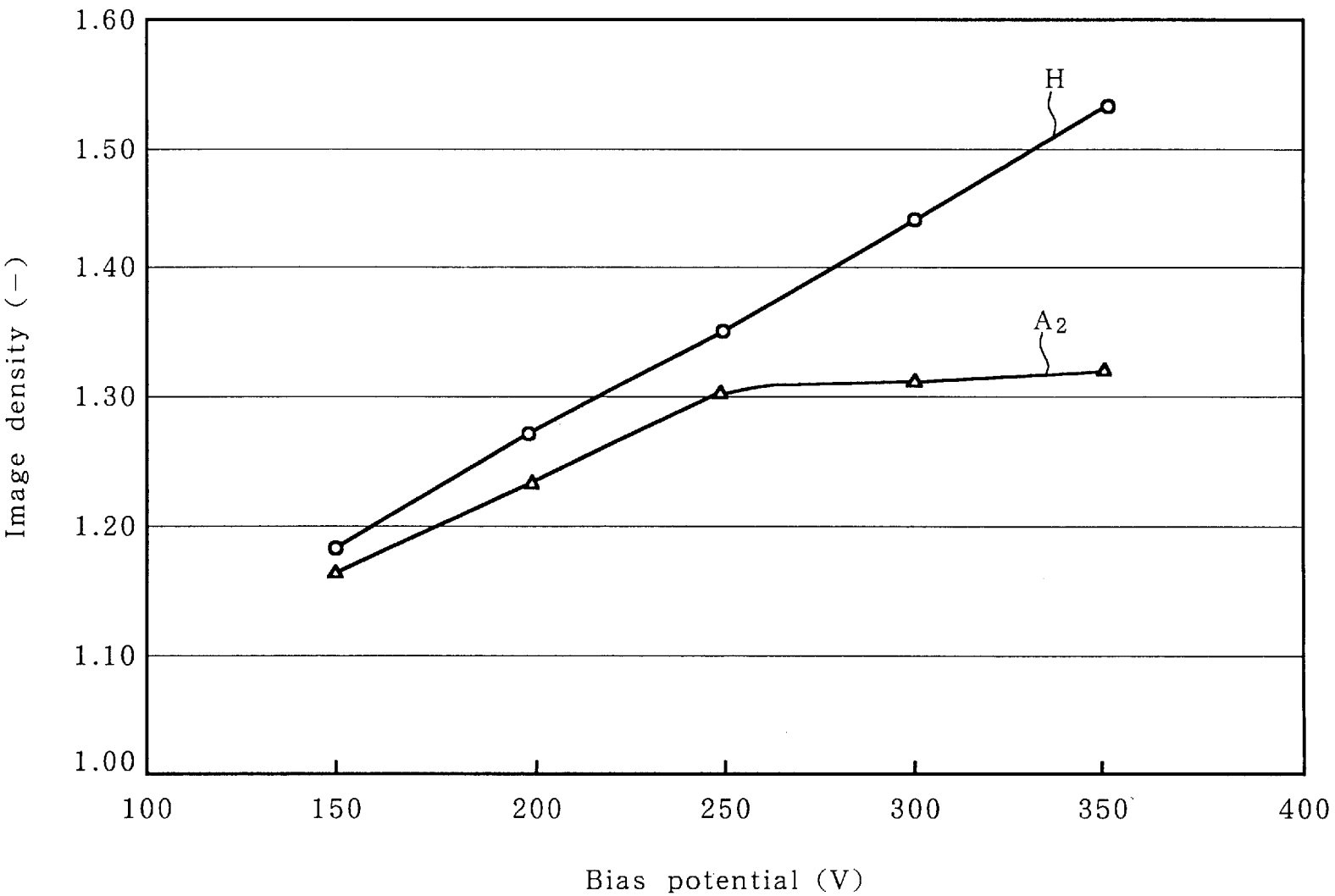
FIG. 6 is a view showing the relation between bias potential (voltage) and image density.

As is clear from FIG. 6, it is understood that, by embedding a magnetic powder in a coating layer of a carrier for electrophotography and by forming a surface polyethylene coating layer so as to coat the magnetic powder, the bias potential (voltage) is proportional to the image density and hence a reduction in the image density is lessened even in high bias potential zones. It is thus possible to obtain a clear printing contrast and stable image characteristics.

INDUSTRIAL APPLICABILITY

As described above, the present invention can provide a carrier for electrophotography, which is excellent in durability and a charging property, gives clearer light and shade in real printing than the conventional one, and allows fine and free adjustment of static resistance and charge quantity, and a developer using the carrier.

TABLE 2

| | Carrier | Magnetic Powder | Temp. (° C.) | Time (Hrs) | Thick.* (μm) | LL (μC/g) | NN (μC/g) | HH (μC/g) |
|---|---|---|---|---|---|---|---|---|
| Example 6 | H | Octa-Hedron | 70 | 3 | 0.005 | 13.1 | 12.8 | 12.5 |
| Example 7 | J | Octa-Hedron | 100 | 1 | 0.05 | 15.1 | 14.4 | 14.1 |
| Example 8 | K | Octa-Hedron | 80 | 4 | 0.01 | 25.4 | 23.9 | 23.3 |
| Example 9 | L | Octa-Hedron | 90 | 3 | 0.009 | 8.2 | 7.8 | 7.7 |
| Example 10 | M | Octa-Hedron | 100 | 6 | 0.08 | 23.4 | 12.4 | 11.8 |
| Example 11 | N | Poly-Hedron | 70 | 3 | 0.007 | 14.0 | 13.6 | 13.2 |
| Example 12 | P | Octa-Hedron | 70 | 3 | 0.005 | 16.2 | 16.0 | 16.0 |
| Example 13 | Q | Octa-Hedron | 70 | 3 | 0.005 | 9.1 | 8.8 | 8.7 |
| Example 14 | R | Octa-Hedron | 40 | 3 | 0 | 13.4 | 13.0 | 6.9 |
| Comparative Example 1 | $A_2$ | — | — | — | 0 | 18.5 | 15.2 | 4.8 |

*"Thick" stands for the thickness of the surface PE layer.

Examples 15 and 16 and Comparative Example 4

To each of the carriers H, R and $A_2$ obtained in Examples 6 and 14 and Comparative Example 1 respectively was added a toner (TK-12 model, manufactured by Kyocera Co.) in a manner that the amount of the toner to be added was 5% by weight based on the total amount to form a developer for electrophotography.

Next, the resulting developers for electrophotography were respectively placed in a printer, into which an Ecosys FS-3550 (manufactured by Kyocera Co.) was remodeled, to make an actual printing of 50,000 copies in the condition that the bias potential (voltage) was fixed at 300 V while the image density of a solid portion was measured at regular intervals by using a Macbeth densitometer.

Figure 5:
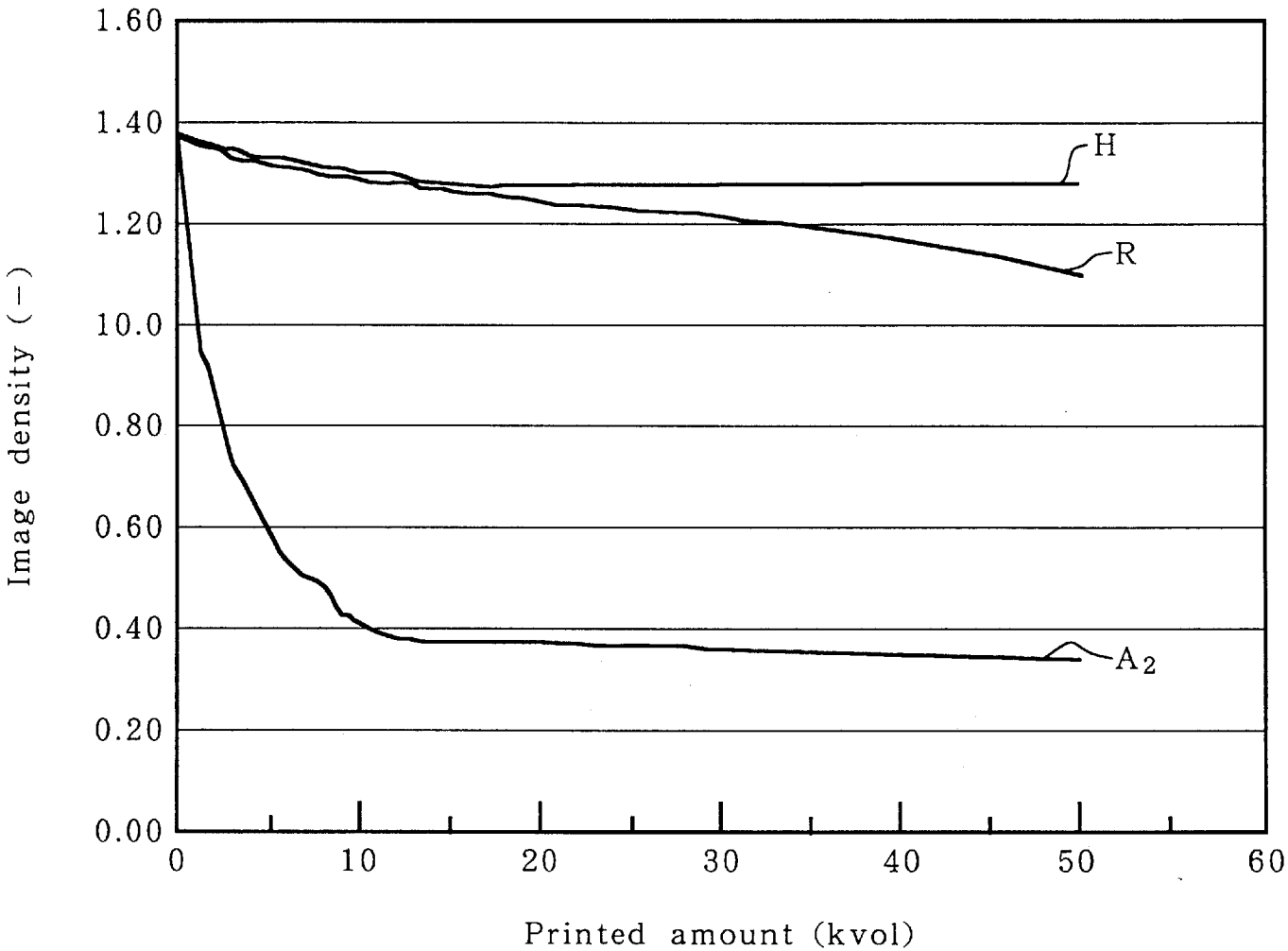
FIG. 5 is a view showing the relation between the number of printed amount (copies) and image density.

Incidentally, the printer was remodeled so that the surface potential of a sensitive body and the bias potential of a magnet roller could be controlled. The results are shown in FIG. 5.

What is claimed is:

1. A carrier for electrophotography comprising a carrier core material provided with magnetism and a coating layer which coats the surface of the carrier core material and comprises a high molecular weight polyethylene resin having a weight average molecular weight of 50,000 or more, wherein an outermost layer containing a magnetic powder having a three-dimensional form of a convex polyhedron is formed on the outermost surface of the coating layer.

2. A carrier for electrophotography according to claim 1, wherein the average particle diameter of the magnetic powder is in a range from 0.1 to 1 μm.

3. A carrier for electrophotography according to claim 1, wherein the surface of the magnetic powder is treated hydrophobically.

4. A carrier for electrophotography according to claim 1, wherein the magnetic powder is embedded in the coating layer to form the outermost layer and the surface polyethylene coating layer is formed so as to coat the magnetic powder.

5. A carrier for electrophotography according to claim 1, wherein the thickness of the surface polyethylene coating layer is in a range from 0.005 to 0.08 $\mu$m.

6. A carrier for electrophotography according to claim 1, wherein at least one material selected from the group consisting of carbon black, silica and a charging characteristic resin is compounded in the coating layer.

7. A carrier for electrophotography according to claim 1, wherein the volumetric resistance of the carrier for electrophotography is in a range from $1\times10^{2}$ to $1\times10^{14}$ $\Omega$.cm.

8. A carrier for electrophotography according to claim 1, wherein the average particle size of the carrier for electrophotography is in a range from 20 to 120 $\mu$m.

9. A process for producing a carrier for electrophotography comprising a carrier core material provided with magnetism and a coating layer which coats the surface of the carrier core material and comprises a high molecular weight polyethylene resin having a weight average molecular weight of 50,000 or more, the process comprising forming the coating layer by a direct polymerization method and thereafter embedding a magnetic powder, having a three-dimensional form of a convex polyhedron, in the coating layer by a mechanical impact to form an outermost layer.

10. A process for producing a carrier for electrophotography according to claim 9, wherein the magnetic powder having a three-dimensional form of a convex polyhedron is embedded in the coating layer at a temperature ranging between 50 and 120° C. by a mechanical impact to form the outermost layer and the surface polyethylene coating layer is formed so as to coat the magnetic powder.

11. A developer for electrophotography comprising the carrier for electrophotography according to claim 1 and a toner, wherein the mixing ratio of the carrier for electrophotography is in a range from 2 to 40% by weight to the total amount of the carrier and the toner.

* * * * *